US007070082B2

(12) United States Patent
Ronconi

(10) Patent No.: US 7,070,082 B2
(45) Date of Patent: Jul. 4, 2006

(54) PNEUMATIC GUN FOR FIXING ELEMENTS

(75) Inventor: Marco Ronconi, Bologna (IT)

(73) Assignee: FASCO S.p.A., Bologna (IT)

( * ) Notice: Subject to any disclaimer, the term of this patent is extended or adjusted under 35 U.S.C. 154(b) by 0 days.

(21) Appl. No.: 10/786,801

(22) Filed: Feb. 25, 2004

(65) Prior Publication Data

US 2004/0169057 A1 Sep. 2, 2004

(30) Foreign Application Priority Data

Feb. 28, 2003 (IT) ..... BO2003A0105

(51) Int. Cl.
*B25C 5/02* (2006.01)

(52) U.S. Cl. ..... 227/127; 227/120

(58) Field of Classification Search ..... 227/120, 227/130, 127, 128, 136, 125, 121
See application file for complete search history.

(56) References Cited

U.S. PATENT DOCUMENTS

| | | | | |
|---|---|---|---|---|
| 3,437,250 | A * | 4/1969 | Fiedler | 227/127 |
| 4,304,349 | A * | 12/1981 | Novak et al. | 227/109 |
| 4,433,782 | A * | 2/1984 | Figge et al. | 206/338 |
| 4,463,888 | A * | 8/1984 | Geist et al. | 227/109 |
| 5,653,371 | A * | 8/1997 | Hou | 227/109 |
| 6,308,880 | B1 * | 10/2001 | Ronconi | 227/119 |

FOREIGN PATENT DOCUMENTS

| | | | |
|---|---|---|---|
| IT | 0928666 | A2 * | 12/1998 |
| IT | 1325795 | A3 * | 4/2004 |

* cited by examiner

*Primary Examiner*—Scott A. Smith
*Assistant Examiner*—Brian Nash
(74) *Attorney, Agent, or Firm*—William J. Sapone; Coleman Sudol Sapone, P.C.

(57) ABSTRACT

A pneumatic gun for fixing elements, comprising a body (2) provided with pneumatically-actuated mechanism for expelling the fixing elements, a handle (3) that protrudes from the body (2) and a magazine (4), for storing and individually feeding the elements, defined by a box-like container (11) provided with a sliding flap (13) for inserting the elements, the body (2) being provided with a working head (8) for driving the elements that can be coupled to a complementary end head (9) of the box-like container (11) that is affected by an opening (18) for the passage of the elements and is adapted to form, together with the head (8), a firing channel (7) for the elements; the gun comprises a guide (38) that runs from the head (8) to the handle (3) and with which the box-like container (11) is coupled slidingly so as to allow a manual translational motion of the magazine (4) from a first active end position, in which the complementary head (9) is adjacent to the head (8), allowing the expulsion of the elements through the firing channel (7), to a second position, in which the complementary head (9) is substantially spaced from the head (8) in order to allow access to the firing channel (7).

5 Claims, 5 Drawing Sheets

PNEUMATIC GUN FOR FIXING ELEMENTS

BACKGROUND

The present invention relates to a pneumatic gun for fixing elements.

Pneumatically-actuated guns for driving fixing elements, such as nails, staples and the like of various shapes and dimensions are widely used in various professional fields and sectors. These guns are generally constituted by a body that comprises the means for diving the fixing elements, an ergonomic handle, and a magazine of the fixing elements: such elements are usually available and loaded by being packed in stacks or sets and are fed one by one into a suitable firing channel through which they are expelled at high speed.

The strongly felt need to be able to perform maintenance on the gun, for example following accidentally incorrect arrangements of the fixing elements or other malfunctions or jammings, has led to the provision of a fixing element magazine that is detachable or disengageable, so as to allow the user to access in full safety the parts of the gun where it is necessary to intervene in order to restore its correct functionality.

Guns are known in which the fixing element magazine, which is generally straight and box-like, is connected detachably, for example at its opposite ends, respectively to the body of the gun and to the handle or is coupled thereto so as to slide or rotate about a fulcrum. Although these refinements allow to move or remove the magazine in order to access the firing channel and perform other maintenance actions, they require for this purpose a plurality of operations that are rather laborious, awkward and complicated and entail a considerable time expenditure.

Moreover, these methods of connection between the magazine and the body of the gun often do not ensure maximum safety and reliability during work, since they can often cause malfunctions or jammings.

SUMMARY OF THE INVENTION

The aim of the present invention is to obviate the cited drawbacks, by providing a pneumatic gun in which it is possible to access easily, rapidly and effectively the fixing element firing channel in order to perform maintenance actions and restore the correct operation of the gun.

Within this aim, an object of the present invention is to provide a pneumatic gun in which the fixing element magazine can be removed with a limited number of simple operations that can even be performed with just one hand in order to be reloaded or exchanged.

Another object of the present invention is to provide a pneumatic gun having a structure that is simple, relatively easy to provide in practice, safe in use, effective in operation, and has a relatively low cost.

This aim and these and other objects that will become better apparent hereinafter are achieved by the present pneumatic gun for fixing elements, comprising a body provided with pneumatically-actuated means for expelling the fixing elements, a handle that protrudes from said body and a magazine for storing and individually feeding said elements, which is constituted by a box-like container provided with a sliding flap for inserting said elements, said body being provided with a working head for driving said elements that can be coupled to an end head of said box-like container that is affected by an opening for the passage of said elements and is suitable to form, together with said head, a firing channel for said elements, characterized in that it comprises a guide that runs from said head to said handle and with which said box-like container is coupled slidingly so as to allow a manual translational motion of said magazine from a first active end position, in which said complementary head is adjacent to said head, allowing the expulsion of said elements through said firing channel, to a second position, in which said complementary head is substantially spaced from said head in order to allow access to said firing channel.

Further characteristics and advantages of the invention will become better apparent from the following detailed description of a preferred but not exclusive embodiment of a pneumatic gun for fixing elements according to the invention, illustrated by way of nonlimiting example in the accompanying drawings, wherein:

BRIDF DESCRIPTION OF THE DRAWINGS

DETAILED DESCRIPTION OF THE INVENTION

Figure 1:
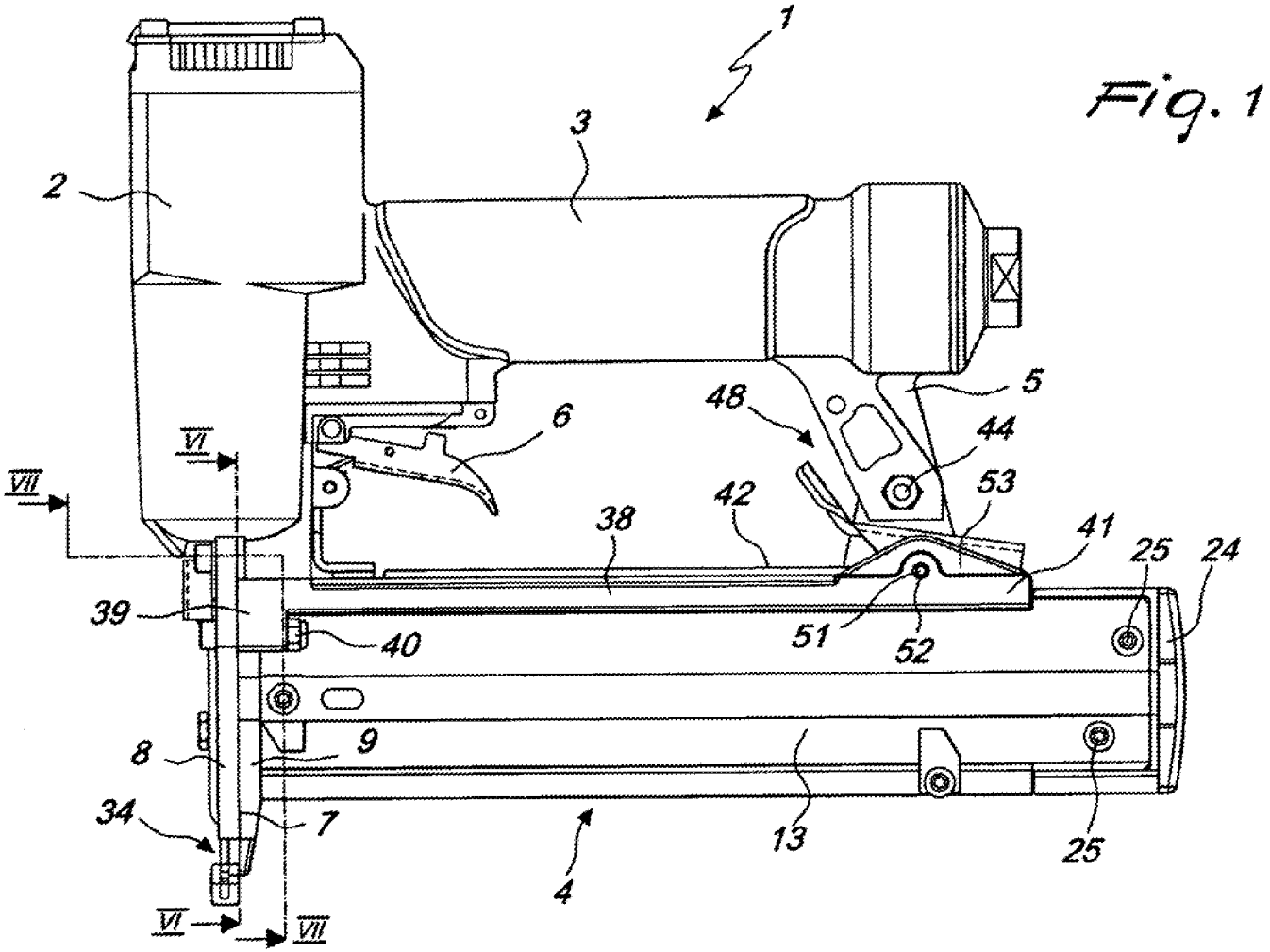
FIG. 1 is a side elevation view of a first side of the pneumatic gun according to the invention.

In the embodiments that follow, individual characteristics, given in relation to specific examples, may actually be interchanged with other different characteristics that exist in other embodiments.

With reference to the figures, the reference numeral 1 generally designates a pneumatic gun for fixing elements according to the invention.

The pneumatic gun, of the type designed to be used easily with a single hand, comprises a body 2 from which a straight ergonomic handle 3 extends at right angles. The body 2 is substantially cylindrically symmetrical and is provided with means for expelling the fixing elements; the gun further comprises a magazine 4 for storing and individually feeding such elements, which are constituted for example by nails of various shapes and sizes.

The means for expelling the fixing elements are preferably of the type with a pneumatic striker and are not shown in detail in the figures because they are known. The handle 3 of the gun has, at its free end, a substantially perpendicular extension 5 and encloses a compressed-air tank for supplying the fixing element firing means.

At the portion connecting the body 2 of the gun and the handle 3 there is a button 6 for actuating the expulsion means; such button allows, every time the operator applies manual pressure, to activate in a pulsed manner the striker in order to eject a single fixing element.

The fixing elements are expelled one by one through a suitable firing channel 7 formed by two mutually opposite notches provided respectively in an elongated head 8, which is coupled monolithically to the body 2 of the gun so as to form a sort of beak, and a complementary head 9, which is connected rigidly to the fixing element magazine 4 for example by means of screws 10.

The magazine 4 is constituted by a box-like container 11 that is substantially shaped like a parallelepiped that is elongated and open along one side, so as to form a compartment for inserting the fixing elements; the box-like container 11 has a side that forms two mutually opposite longitudinal ribs 12 and has, in order to block the opening along the side, a sliding flap 13 that is associated with a fastening device 14 that is adapted to keep the magazine 4 closed during normal use of the gun.

The box-like container 11 is affected, at the end that lies opposite with respect to the end for connection to the complementary head 9, by a sort of window 15, in which a contoured tooth 17 is inserted and locked for example by means of screws 16; the tooth protrudes outward and has a substantially triangular transverse cross-section.

Figure 6:
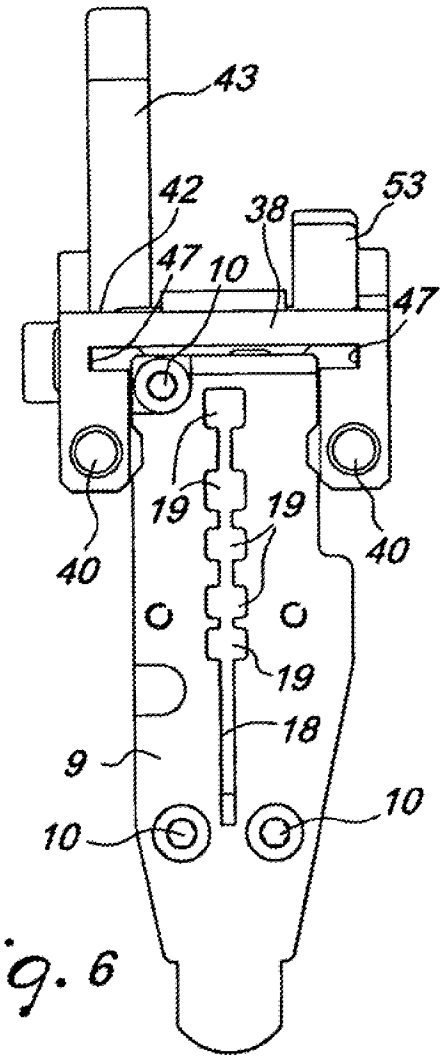
FIG. 6 is a transverse sectional view of the pneumatic gun according to the invention, taken along the line VI—VI of FIG. 1.

The complementary head 9 has a narrow and elongated passage opening 18 for the fixing elements that leads to the firing channel 7; the passage opening 18 is provided so that it is substantially universal, since it has a plurality of wider regions 19 that allow the exit of fixing elements (particularly of the heads, in the case of nails as in this instance) of different sizes (reference should be made to FIG. 6 in this regard).

Figure 7:
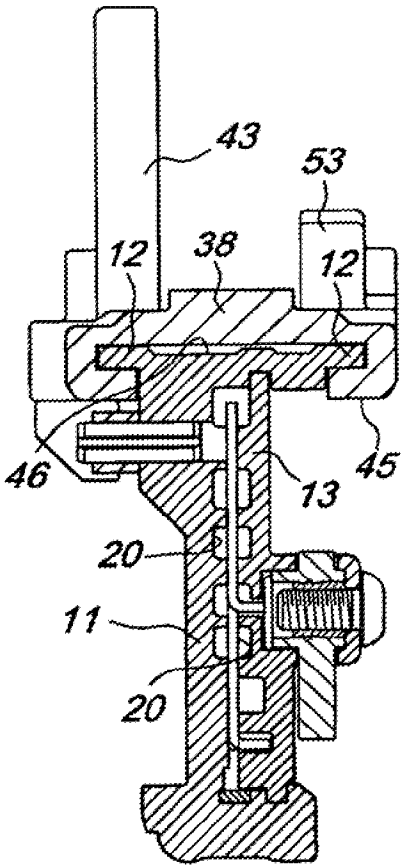
FIG. 7 is a transverse sectional view of the pneumatic gun, taken along the line VII—VII of FIG. 1.

The box-like container 11 and the sliding flap 13 have respective mutually opposite internal walls affected by corresponding longitudinal grooves 20 that are connected to the wider regions 19 of the passage opening 18 for the fixing elements (FIG. 7); such grooves 20 constitute a sort of guide for the advancement of the fixing elements inside the magazine 4 toward the passage opening 18.

Figure 4:
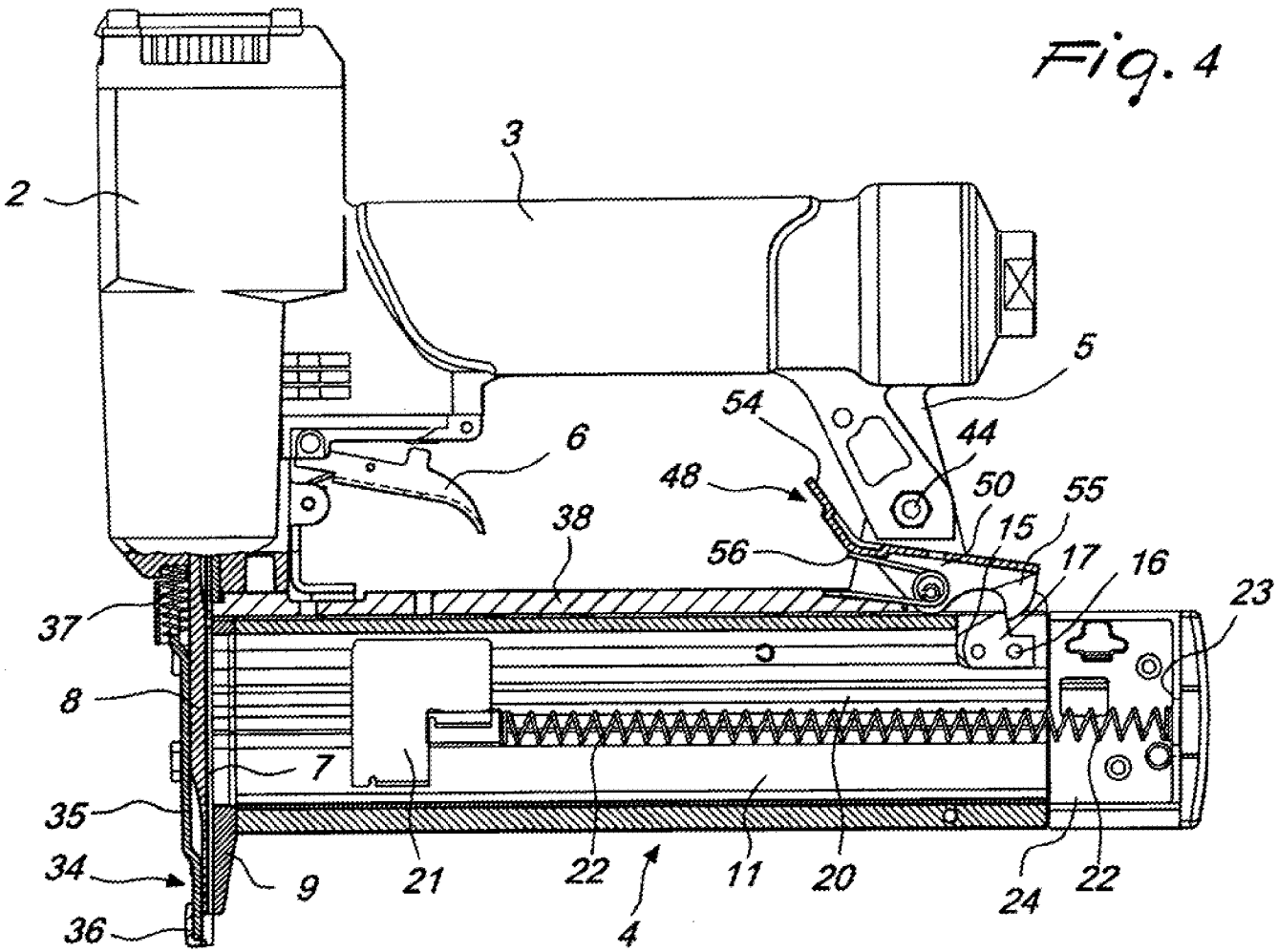
FIG. 4 is a partially sectional side elevation view of the pneumatic gun according to the invention, with the head and the complementary head arranged mutually adjacent so as to form the fixing element firing channel.
Figure 5:
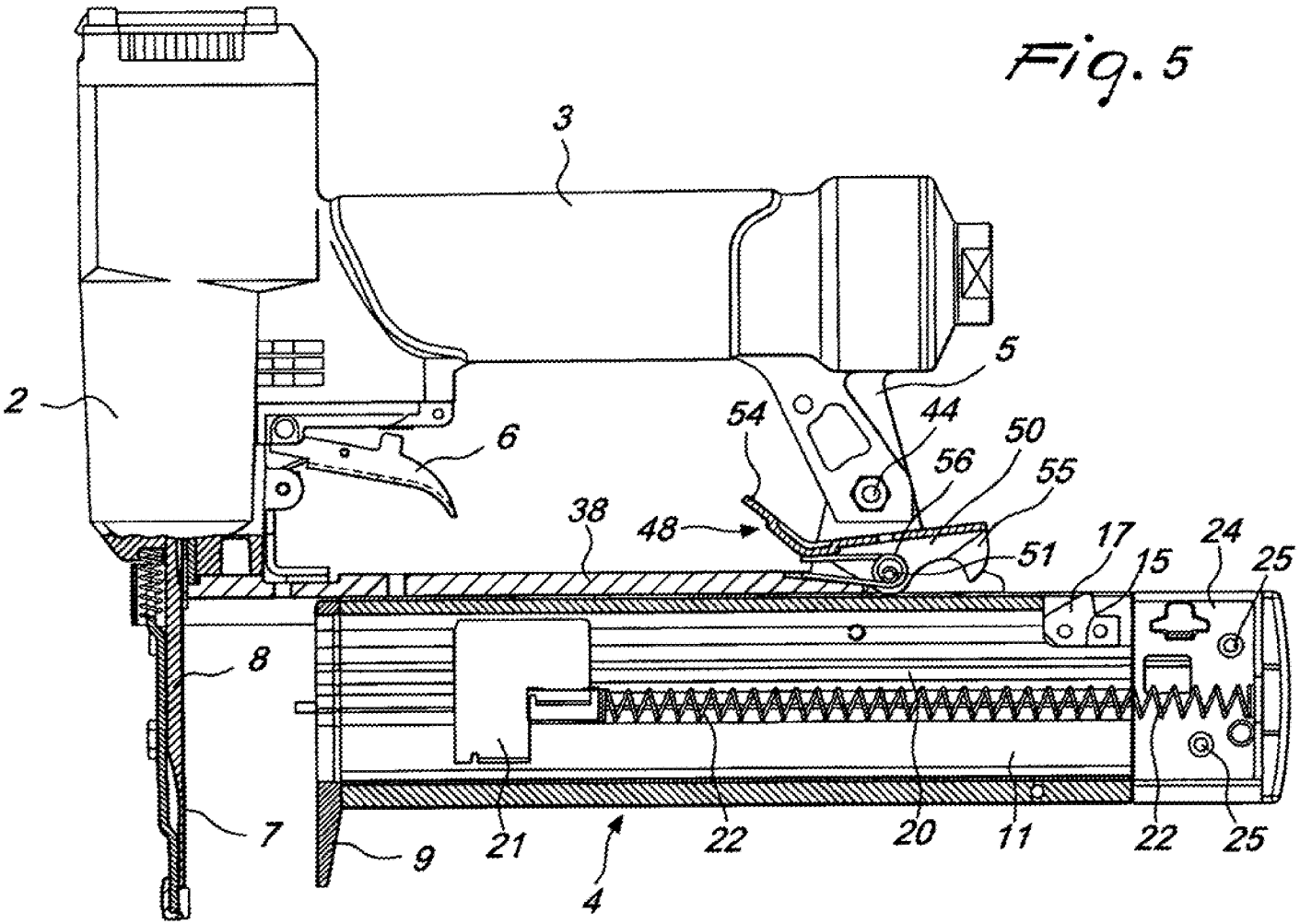
FIG. 5 is a partially sectional side elevation view of the gun, with the head and the complementary head spaced apart in order to allow access to the fixing element firing channel.

A pusher 21 (FIGS. 4 and 5) is guided so that it can slide longitudinally inside the magazine 4 and allows the advancement of the fixing elements along the grooves 20 so that they are arranged one after the other at the firing channel 7 in order to be expelled. The pusher 21 is associated with a first end of a helical spring 22 whose second end abuts against an abutment surface 23 provided in a plate 24 that is rigidly coupled (by way of screws 25) to the rear end of the flap 13.

Figure 3:
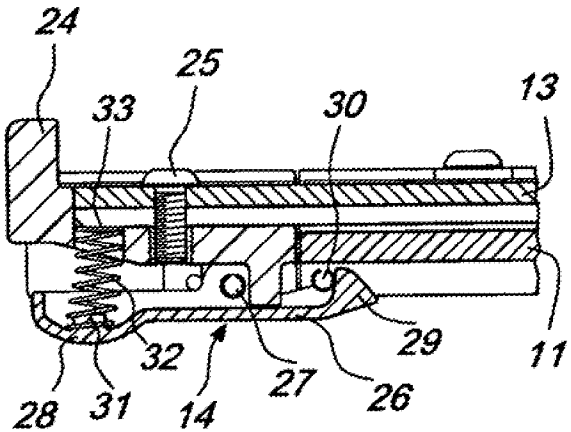
FIG. 3 is a sectional view of a detail of the fixing element magazine, taken along a longitudinal plane.

The fastening device 14 comprises a sort of rocker 26 that is articulated, substantially at the centerline, to a pivot 27, which in turn is supported transversely and at its ends in the plate 24 (FIG. 3). The rocker 26 has a first end 28 for manual actuation and a second end that forms a sort of lug 29 that is adapted to engage by straddling a respective pin 30 that is transversely rigidly coupled, at its ends, to the outside wall of the box-like container 11. The first end 28 for manual actuation forms a substantially cylindrical raised portion 31 that is coupled to one end of a helical spring 32 whose opposite end is inserted with interference in a hole 33 formed in the plate 24. The rocker 26 accordingly can rotate manually between a first stable angular position, in which the lug 29 engages by straddling the pin 30 so as to prevent the sliding of the flap 13 and the opening of the magazine 4, and a second angular position, which is determined by the manual pressure of the operator on the first end 28 and is contrasted by the loading of the spring 32. In this second angular position, the lug 29 is disengaged from the pin 30, allowing the flap 13 to slide and accordingly allowing the magazine 4 to open.

At the head 8 of the gun there is a safety device 34 that allows to expel the fixing elements only when the head 8 is arranged on the surface into which the element is to be driven. The safety device 34 comprises a lamina 35 that is guided so that it can slide parallel to the surface of the head 8 and has an end provided with a sort of hood 36 for abutment on the surface being worked, and is associated at its opposite end with one end of a contrast spring 37; the other end of the contrast spring 37 is inserted in a suitable recess formed in the surface of the body 2 of the gun.

According to the invention, the gun comprises a straight guide 38 that runs from the head 8 to the extension 5 of the handle 3 and in which the box-like container 11 is coupled slidingly, so as to allow the manual translational motion of the magazine 4 from a first active end position, in which the complementary head 9 is adjacent to the head 8, allowing the correct expulsion of the fixing elements through the firing channel 7, to a second position, in which the complementary head 9 is substantially spaced from the head 8. In this second position, the operator can access freely and safely the firing channel 7, for example to remove a badly positioned element that obstructs the expulsion of the subsequent elements, or more generally to perform gun maintenance actions.

The guide 38 is preferably constituted by a profiled element, which forms a first end 39 for fixing by way of front screws 40 to the head 8 and a second end 41 that is adapted for connection to the extension 5 of the handle 3: in the specific case, the guide 38 forms, on the back 42 and at the second end 41, a sort of eye 43 by way of which it is coupled to the extension 5 by screw means 44 (for example a through screw with a locking nut).

The internal surface 45 of the profiled element is affected by a longitudinal slot 46 that is open at the rear and along which the box-like container 11 can slide. The longitudinal slot 46 of the guide has a substantially T-shaped transverse cross-section (FIGS. 6 and 7) and forms two squared guides 47 along which the ribs 12 of the box-like container 11 engage slidingly.

The guide 38 is provided with means 48 for the quick manual locking and release of the translational motion of the box-like container 11 along the longitudinal slot 46. The locking and release means 48, moreover, are associated with a safety closure 49 that is adapted to prevent the accidental extraction of the box-like container 11 from the guide 38.

The locking and release means 48 comprise a lever 50 which is pivoted, at its centerline, to a pivot 51, whose ends are engaged in respective opposite coaxial holes 52 that are formed transversely in the eye 43 and in a lug 53 on the back 42 of the guide 38. The lever 50 has a first end portion 54 for manual actuation and a second end portion that forms a sort of beak 55 that has a rounded profile and is adapted to abut against the contoured tooth 17 that is monolithic with the box-like container 11; elastic means 56 are interposed between the first end portion 54 and the back 42 of the guide 38 and are preferably constituted by a coiled spring wound around the pivot 51. The lever 50 can rotate manually from a first stable angular position, ensured by the elastic action of the coiled spring 56, in which the beak 55 engages the contoured tooth 17, locking the sliding of the box-like container 11 along the guide 38 (FIG. 4), to a second angular position, obtained by pressing manually on the first end portion 54, in which the beak 55 is substantially disengaged from the tooth 17, allowing the box-like container 11 to slide along the guide 38 (FIG. 5), even to the extent of producing complete disengagement of the ribs 12 from the respective guides 47.

Figure 2:
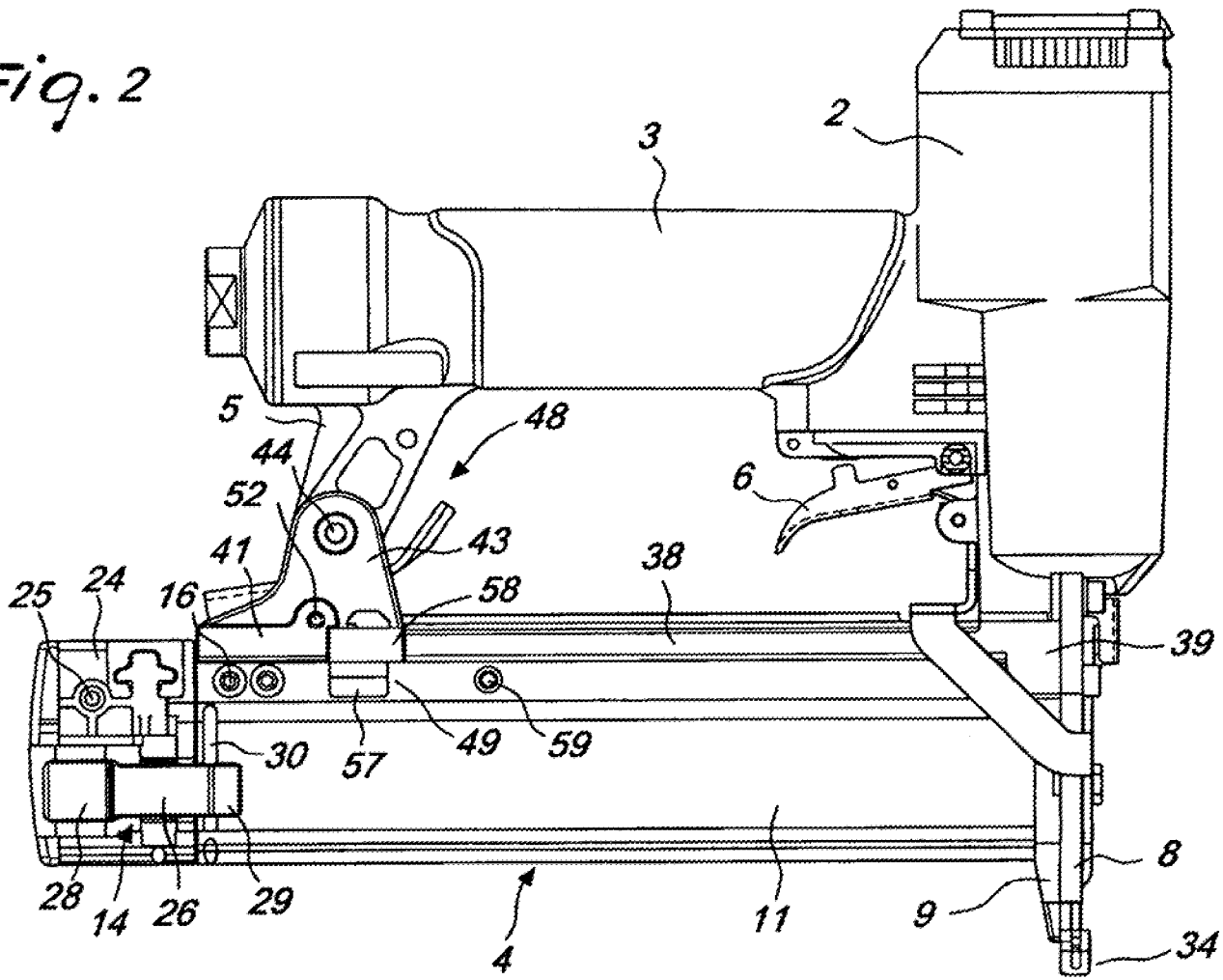
FIG. 2 is a side elevation view of a second side of the pneumatic gun.

The safety closure 49 for preventing unwanted accidental disengagement of the box-like container 11 is constituted by an insert 57 that is engaged detachably in a sort of open pocket 58, which is rigidly coupled to the guide 38 along one side (FIG. 2): the insert 57 is adapted to abut by interference against an appropriately provided retention protrusion 59 that is provided along the outer wall of the box-like container 11, so as to prevent the sliding thereof along the guide 38 beyond a preset position. The retention protrusion 59 can be constituted for example by the head of a screw that is screwed into a respective threaded hole formed in the outer wall.

The method of use of the pneumatic gun according to the invention is intuitive. If it is necessary, during use of the gun, to access the head 8, the complementary head 9 and the firing channel 7 freely and easily in order to perform maintenance actions, for example to remove badly positioned or jammed fixing elements that obstruct the passage opening 18 and the firing channel 7, an appropriate pressure (such as to overcome the action of the coiled spring 56) is applied manually to the first end portion 54 of the lever 50 toward the back 42 of the guide 38. The lever 50 is consequently rotated from the first stable angular position to the second angular position, so as to disengage the beak 55 from the contoured tooth 17. This allows the free manual sliding of the box-like container 17 along the longitudinal slot 46 of the guide 38 from the first active end position to the second position (FIG. 5), in order to space the complementary head 9 from the head 8 and access the firing channel 7. The interference between the insert 57 and the retention protrusion 59 causes the retention of the magazine 4 in said second position, preventing a further sliding thereof that might cause its accidental disengagement. In order to produce a further translational motion of the magazine 4 with respect to the guide or extract it completely from the guide, it is necessary to remove the insert 57 from the respective pocket 58.

The manual translational motion of the magazine in the opposite direction 4 until the complementary head 9 mates perfectly with the head 8 allows the rotation of the lever, by contact of the rounded profile of the beak 55 with the triangular contoured tooth 17, from the first angular position to the second angular position: the beak 55 thus engages in a ratchet-like manner the contoured tooth 17, blocking the sliding of the magazine 4 along the guide 38.

It has thus been shown that the invention achieves the intended aim and objects.

By acting on the lever 50, the magazine 4 can be moved easily along the guide 38, so as to disengage the complementary head 9 from the head 8 in order to perform any gun maintenance operation, even with a single hand. Moreover, the magazine can be extracted rapidly and handily, after extracting the insert 57, in order to be reloaded by way of fixing elements or to be replaced with another one.

The invention thus conceived is susceptible of numerous modifications and variations, all of which are within the scope of the appended claims.

All the details may further be replaced with other technically equivalent ones.

In practice, the materials used, as well as the shapes and the dimensions, may be any according to requirements without thereby abandoning the scope of the protection of the appended claims.

The disclosures in Italian Patent Application No. BO2003A000105 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A pneumatic gun for fixing elements, comprising a body (2) provided with pneumatically-actuated means for expelling said elements, a handle (3) that protrudes from said body(2) and a magazine (4) for storing and individually feeding the fixing elements, which is constituted by a box-like container (11) having a sliding flap (13) for inserting said elements, said body (2) having a working head (8) for driving said elements that can be coupled to a complementary end head (9) of said box-like container (11) having an opening (18) for the passage of said elements and forming, together with said head (8), a firing channel (7) for said elements, a guide (38) running from said head (8) to said handle (3) and coupled slidingly with said box-like container (11) so as to allow a manual translational motion of said magazine (4) from a first active end position, in which said complementary head (9) is adjacent to said head (8), allowing the expulsion of said elements through said firing channel (7), to a second position, in which said complementary head (9) is substantially spaced from said head (8) in order to allow access to said firing channel (7), said guide (38) being provided with means (48) for rapid manual locking and release of the translational motion of said box-like container (11), said locking and release means (48) having a releasable safety closure (49) for preventing the translational motion of said box-like container (11) when in the second position and accidental disengagement from said guide (38), the safety closure having means for stopping a stroke of the magazine said means being an insert (57) engaged detachably in a respective pocket (58) provided in said guide (38), for abutting against a retention protrusion (59) provided along said box-like container (11) such that to produce a further translational motion of the magazine (4) with respect to the guide or to extract the magazine completely, the insert (57) must be removed from the respective pocket.

2. The gun according to claim 1 wherein said guide (38) has a profiled element arranged substantiafly at right angles to said head (8) for forming a longitudinal slot (46) along which said container (11) is slidable.

3. The gun according to claim 1, characterized in tat said locking and release means (48) comprise a lever (50) pivotably mounted, substantially at its centerline, to said guide (38) and has a first end portion (54) for actuation and a second end portion that forms a beak (55) tat abuts against a contoured toot (17) that is monolithic wit said box-like container (11), elastic means (56) interposed between said first end portion (54) and said guide (38), said lever (50) being manually rotatable from a first stable angular position, biased by said elastic means (56), for locking the sliding of said box-like container (11), in which said beak (55) is engaged on said contoured toot (17), to a second angular position, in which said beak (55) is substantially disengaged from said tooth (17), allowing the free sliding of said box-like container (11) along said guide (38).

4. The gun according to claim 2, wherein said longitudinal slot(46) of said guide (38) has a substantially T-shaped transverse cross-section.

5. The gun according to claim 1, wherein said guide (38) has an eye (43) for detachably connecting an extension (5) of said handle (3).

* * * * *